US007044723B2

(12) United States Patent
Morozumi et al.

(10) Patent No.: US 7,044,723 B2
(45) Date of Patent: May 16, 2006

(54) SCROLL COMPRESSOR HAVING A THROTTLE PIN MOVING IN THE LONGITUDINAL HOLE OF THE OIL SUPPLY PASSAGE

(75) Inventors: Naoya Morozumi, Kawasaki (JP); Masaki Fujino, Kawasaki (JP); Junya Tanaka, Kawasaki (JP); Takayoshi Nakazawa, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 10/934,554

(22) Filed: Sep. 7, 2004

(65) Prior Publication Data

US 2005/0053508 A1 Mar. 10, 2005

(30) Foreign Application Priority Data

Sep. 10, 2003 (JP) ..... 2003-317803

(51) Int. Cl.
*F04C 18/00* (2006.01)
*F01C 1/02* (2006.01)

(52) U.S. Cl. ..... 418/55.6; 418/55.1; 418/57; 418/94; 418/55.5; 184/6.18

(58) Field of Classification Search ..... 418/55.6, 418/55.1, 55.5, 57, 94; 184/6.18
See application file for complete search history.

(56) References Cited

FOREIGN PATENT DOCUMENTS

| | | | |
|---|---|---|---|
| JP | 03149388 A | * | 6/1991 |
| JP | 04001485 A | * | 1/1992 |
| JP | 06307358 A | * | 11/1994 |
| JP | 07332265 A | * | 12/1995 |
| JP | 10159759 A | * | 6/1998 |
| JP | 2001193676 A | * | 7/2001 |
| JP | 2002081389 A | * | 3/2002 |
| JP | 2003021085 A | * | 1/2003 |

* cited by examiner

*Primary Examiner*—Theresa Trieu
(74) *Attorney, Agent, or Firm*—Manabu Kanesaka

(57) ABSTRACT

A scroll compressor supplies an optimum quantity of lubricating oil to a refrigerant compressing section and restrains a decrease in compression efficiency caused by gas leakage. An oil supply passage (35) whose discharge port is open to a joint surface of a main frame (3) and a fixed scroll (4) is provided, and a throttle pin (353) is inserted in the oil supply passage (35) with a predetermined clearance to regulate the inflow quantity of lubricating oil (0). Also, a groove-shaped connecting portion is formed in the joint surface on the main frame side to connect the discharge port to a compression chamber (43).

8 Claims, 3 Drawing Sheets

SCROLL COMPRESSOR HAVING A THROTTLE PIN MOVING IN THE LONGITUDINAL HOLE OF THE OIL SUPPLY PASSAGE

TECHNICAL FIELD

The present invention relates to a scroll compressor used in a refrigerating cycle for an air conditioner or the like and, more particularly, to a scroll compressor in which a compression loss due to gas leakage in a refrigerant compressing section is reduced.

BACKGROUND ART

In a scroll compressor, a fixed scroll and an orbiting scroll having spiral scroll wraps erecting perpendicularly on an end plate are engaged with each other with the scroll wraps, and thereby a refrigerant compressing section forming a compression chamber (closed operation chamber) therein is provided.

In the refrigerant compressing section, by rotating the orbiting scroll by a rotational driving shaft provided with a crankshaft, the crescent-shaped compression chamber formed by the scroll wraps is moved from the outside to the inside while the volume thereof is decreased. Thereby, a low-pressure refrigerant introduced to the inside is compressed into a high-pressure refrigerant.

Generally, in the scroll compressor of this type, lubricating oil is supplied to sliding portions and bearing portions to prevent the orbiting scroll from seizing. As the normal oil supply method, in the case of a vertical closed shell, journal bearings and thrust sliding portions on the back surface of the end plate of orbiting scroll are lubricated during or after the time when lubricating oil stored at the bottom of the closed shell is sucked up to the back surface of the end plate of orbiting scroll through a supply tube provided in the rotational driving shaft.

Also, some of the lubricating oil is sometimes supplied into the compression chamber to reduce gas leakage. One example thereof has been disclosed, for example, in Patent Document 1 (Japanese Patent Application Publication No. 2003-21085). In this Patent Document 1, lubricating oil is fed into a suction space of compression chamber via a lubricating oil supply tube incorporating a throttle pin as a throttling mechanism, and thereby the lubricating oil forms a thin film in the combustion chamber to reduce gas leakage by means of the sealing effect thereof.

However, the scroll compressor having the aforementioned lubricating oil supply mechanism has problems described below. In the scroll compressor described in Patent Document 1, the throttle pin for regulating the inflow quantity of lubricating oil is fixed to the fixed scroll, so that the position of a vertical hole for oil supply engaging with the fixed scroll must be designed with high accuracy, which increases the manufacturing cost.

Also, when accuracy necessary for positioning is required, a clearance between the vertical hole and the throttle pin becomes small, which poses a problem in that an adequate quantity of lubricating oil cannot be obtained. Further, as another example, a throttling mechanism using a nozzle has been disclosed, for example, in Patent Document 2 (Japanese Patent Application Publication No. 2002-81389). When a nozzle is used, however, there arises a problem in that the hole is clogged with dirt and wear particles. If the hole diameter of the nozzle is increased to prevent the clogging, lubricating oil is supplied any more than is necessary. In this case, the refrigerant dissolved in the lubricating oil performs the inherent job, so that the quantity of refrigerant discharged to the refrigerating cycle decreases, which poses a problem of decreased capability.

SUMMARY OF THE INVENTION

The present invention has been made to solve the above-described problems, and accordingly an object thereof is to provide a scroll compressor which can surely supply an optimum quantity of lubricating oil to a refrigerant compressing section and restrain a decrease in compression efficiency caused by gas leakage.

To achieve the above object, the present invention has some features as described below. A first aspect of the present invention provides a scroll compressor in which a refrigerant compressing section, which is formed with a compression chamber therein by engaging spiral scroll wraps erected on end plates of a fixed scroll and an orbiting scroll with each other, and a motor for driving the refrigerant compressing section are provided in a closed shell; a space between the end plate back surface of the orbiting scroll and a main frame is divided into a high-pressure space on the inside diameter side of a thrust ring and a low-pressure space on the outside diameter side thereof by the thrust ring that is in slidable contact with the end plate back surface of the orbiting scroll, and the low-pressure space communicates with a suction space at the outer periphery of wrap; and oil supply means is provided to introduce lubricating oil in the bottom portion of the closed shell to the high-pressure space, wherein the main frame includes an oil supply passage, in which a suction port at one end thereof is open to the high-pressure space, and a discharge port at the other end thereof is open to the low-pressure space or a suction chamber which is located on the outside of the scroll wrap and communicates with the low-pressure space, and a throttle pin, which is arranged in the oil supply passage with a predetermined clearance.

According to the invention of the first aspect, by making the throttle pin in a state in which restraint in the oil supply passage is lifted by the predetermined clearance (what is called free), unlike the conventional example, a fixing hole for fixing the throttle pin need not be provided. Also, there is no need for making the position of oil supply hole highly accurate, so that the fabrication cost can be reduced.

In a second aspect of the present invention, the thrust ring is formed separately from the main frame, and provided so as to be movable finely with respect to the main frame along the axial direction of the motor, and the upper end face of the thrust ring is pressed against the end plate back surface of the orbiting scroll by a difference in pressure.

According to the invention of the second aspect, leakage of refrigerant from a gap between the end plate back surface of orbiting scroll and the thrust ring is eliminated, so that the capability is improved, and on the other hand, oil supply through this gap is also eliminated, so that the compression chamber can be lubricated by the oil supply in accordance with the present invention without a decrease in capability.

In a third aspect of the present invention, the oil supply passage includes a transverse hole a suction port of which is open to the high-pressure space and a longitudinal hole in which a discharge port at one end thereof is open to a joint surface of the main frame and the fixed scroll and the other end thereof is open to the transverse hole, and the discharge port communicates with the suction chamber via a connecting groove formed in almost the entire range in the radial direction of the joint surface.

According to the invention of the third aspect, the fabrication cost of oil supply passage can be reduced. According to the invention of a fourth aspect, the end portion on the side opposite to the suction port of the transverse hole has a high pressure, so that the intrusion of refrigerant into the end portion on the side opposite to the suction port of the transverse hole through the gap with the closed shell can be prevented, and hence the quantity of supplied oil can be stabilized.

In the fourth aspect of the present invention, the throttle pin is provided in the longitudinal hole.

In a fifth aspect of the present invention, the connecting groove consists of a groove provided in the joint surface on the fixed scroll side.

In a sixth aspect of the present invention, the connecting groove is formed in the direction such that the scroll is extended to the outside and in the vicinity of the outermost end of the orbiting scroll.

In a seventh aspect of the present invention, the wrap shape of the scroll wrap is such that the outermost ends of substantially crescent-shapes are provided in almost the same direction as viewed from the center axis in a state of compression start of two compressor chambers formed at the outermost periphery.

In an eighth aspect of the present invention, the end plate of the orbiting scroll is set so as to have an outside diameter such that in one turn of orbiting motion of the orbiting scroll, the outer edge portion thereof is always in contact with the groove.

According to the inventions of the fifth to eighth aspects, the lubricating oil can be supplied to the suction chamber as possible as directly, and hence poor lubrication at the start time can be reduced.

DETAILED DESCRIPTION

Figure 1:
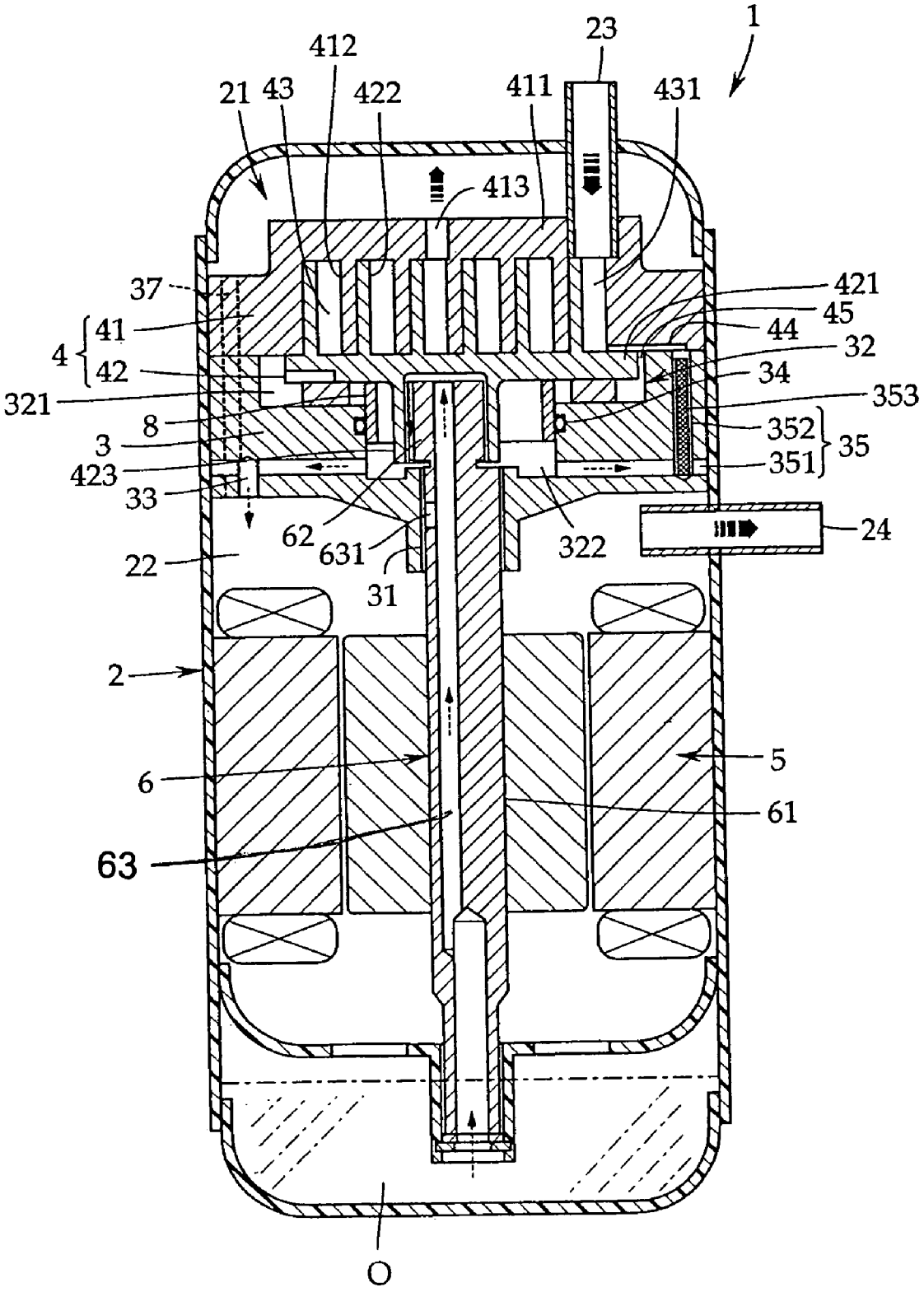
FIG. 1 is a sectional view schematically showing an internal construction of a scroll compressor in accordance with one embodiment of the present invention.

An embodiment of the present invention will now be described with reference to the accompanying drawings. In FIG. 1, a scroll compressor 1 consists of a vertically disposed cylindrical closed shell 2 having a discharge chamber 21 on the upper side and a motor chamber 22 on the lower side, which are divided with a main frame 3 held therebetween.

In the discharge chamber 21, a refrigerant compressing section 4 consisting of a fixed scroll 41 and an orbiting scroll 42 is contained, and in the motor room 22, a motor 5 for driving the refrigerant compressing section 4 and a rotational driving shaft 6 serving as an output shaft of the motor 5 are contained.

For the fixed scroll 41, a spiral scroll wrap 412 is integrally erected on one surface (lower surface in FIG. 1) of a disc-shaped end plate 411, and a discharge port 413 is provided in a substantially central portion of the end plate 411 to discharge a high-pressure refrigerant produced therein into the discharge chamber 21.

For the orbiting scroll 42, a spiral scroll wrap 422 is erected on one surface (upper surface in FIG. 1) of a disc-shaped end plate 421, and a boss 423 into which a crankshaft 62 of the rotational driving shaft 6 for orbiting the orbiting scroll 42 is inserted is formed in the center of the back surface of the end plate 421.

The scroll wraps 412 and 422 of the fixed scroll 41 and the orbiting scroll 42 are caused to face to each other and engaged with each other, by which a compression chamber 43 (closed operation chamber) is formed in the refrigerant compressing section 4.

In this example, the scroll compressor 1 is of an internal high pressure type, and a refrigerant suction pipe 23 is provided in an upper end portion of the closed shell 2 to directly suck a low-pressure refrigerant that has finished its job in a refrigerating cycle, not shown, into a suction chamber 431 divided from the discharge chamber 21.

In a side portion of the closed shell 2, a refrigerant discharge pipe 24 is provided to deliver a compressed high-pressure refrigerant to the refrigerating cycle. Also, in a bottom portion of the closed shell 2, a fixed quantity of lubricating oil O is stored.

In the present invention, the motor 5 has only to have components necessary for the scroll compressing mechanism, and the configuration thereof can be the same as that of the conventional motor. Therefore, the concrete explanation of the motor 5 is omitted.

The rotational driving shaft 6 of the motor 5 includes a main shaft 61 arranged coaxially with the motor 5 and a crankshaft 62 which is formed integrally on the upper end side of the main shaft 6 and arranged eccentrically relative to the main shaft 61.

In the rotational driving shaft 6, a lubricating oil supply tube 63 for supplying the lubricating oil O stored at the bottom of the closed shell 2 to the refrigerant compressing section 4 is formed in an off-centered manner with respect to the rotation axis of the main shaft 61. The lower end of the lubricating oil supply tube 63 is inserted in the lubricating oil O stored at the bottom of the closed shell 2. By the rotation of the rotational driving shaft 6, the lubricating oil O is caused to pass through the lubricating oil supply tube 63, and brought up and supplied from the downside to the back surface of the orbiting scroll 42.

The main frame 3 has a disc shape the outer periphery of which is fixed along to the inside wall surface of the closed shell 2, and a main bearing 31 for pivotally supporting the main shaft 61 of the rotational driving shaft 6 is formed in the center of the main frame 3. On the upper surface side of the main frame 3, a concave portion 32 for housing the orbiting scroll 42 is formed.

The concave portion 32 has a first concave portion 321 the upper end surface side of which is formed annularly so as to be one step lower downward, and an Oldham's ring for preventing the orbiting scroll 42 from rotating is placed in the first concave portion 321.

In the center of the concave portion 32, a second concave portion 322 formed so as to be further one step lower than the first concave portion 321 is formed, and the crankshaft 62 of the rotational driving shaft 6 and the boss 423 of the orbiting scroll 42 are housed in the second concave portion 322.

On the inside wall surface of the second concave portion 322, an annular thrust ring 8 is fitted. The thrust ring 8 is formed of a cylindrical ring body, and the upper end face thereof is in slidable contact with the back surface of the end plate 421 of the orbiting scroll 42. The outer peripheral surface of the thrust ring 8 is sealed via an elastic sealing member 34 embedded along in the inside wall surface of the second concave portion 322.

By this thrust ring 8, a space between the end plate 421 of the orbiting scroll 42 and the main frame 3 is divided into a high-pressure space, which is a space on the inside diameter side of the thrust ring 8 (i.e., the second concave portion 322) and a low-pressure space, which is a space on the outside diameter side of the thrust ring 8 (i.e., the first concave portion 321). Therefore, the low-pressure space 321 substantially communicates with the suction chamber 431, and thus the suction pressure (low pressure) is always provided.

The main frame 3 is further provided with an oil discharge passage 33 for returning the lubricating oil O having finished its job again to the motor chamber 22 and an oil supply passage 35 for supplying some of the lubricating oil O into the suction chamber 431.

For the oil discharge passage 33, a suction port at one end thereof is open to the peripheral wall surface of the second concave portion 322, and a discharge port at the other end thereof is open to the motor chamber 22 from the lower end surface of the main frame 3. The oil discharge passage 33 is formed in an L shape along the radial direction of the main frame 3.

For the oil supply passage 35, a suction port at one end thereof is open to the peripheral wall surface of the second concave portion 322, and a discharge surface at the other end thereof is open to a joint surface of the main frame 3 and the fixed scroll 41. The oil supply passage 35 has a transverse hole 351 extending along the radial direction of the main frame 3 and a longitudinal hole 352 formed in parallel with the axis of the main frame 3.

One end of the transverse hole 351 is open to the second concave portion 322 as the aforementioned suction port, and the other end thereof is closed by the inside wall of the closed shell 2 on the outer peripheral surface of the main frame 3. To a part of the transverse hole 351, the lower end of the longitudinal hole 352 is connected.

The lower end of the longitudinal hole 352 consists of a straight hole the lower end of which is connected to the transverse hole 351 and the upper end of which is provided extendedly to the joint surface of the main frame 3 and the fixed scroll 41 as a discharge port, and a throttle pin 353 for regulating the inflow quantity of lubricating oil O is inserted in the longitudinal hole 352 with a predetermined clearance.

In this embodiment, the throttle pin 353 is formed of a metallic round bar, and inserted slidably in the longitudinal hole 352. According to this configuration, the fabrication cost can be kept low because high positional accuracy of the longitudinal hole 352 is not required. Also, the throttle pin 353 can move easily in the longitudinal hole 352, so that the longitudinal hole 352 can be prevented from being clogged with dirt etc.

In this embodiment, the suction port of the oil discharge passage 33 is open at a position slightly higher than the bottom surface of the second concave 322. On the other hand, the suction port of the oil supply passage 35 is open so as to be approximately flush with the bottom surface of the second concave portion 322.

According to this configuration, if the lubricating oil O is always supplied to the oil supply passage 35, and a fixed quantity of lubricating oil O accumulates at the bottom of the second concave portion 322, unnecessary lubricating oil O flows into the oil discharge passage 33 through the suction port, and is returned into the motor chamber 22.

Figure 2:
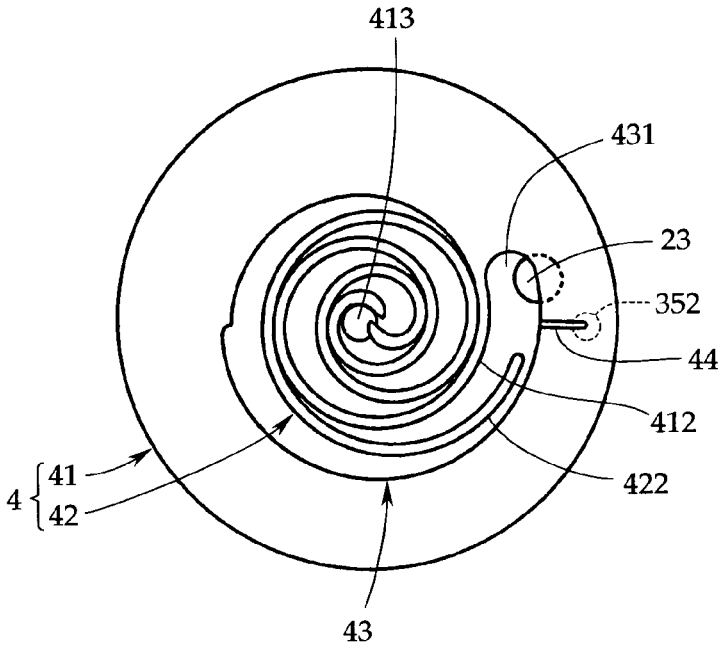
FIG. 2 is an explanatory view for illustrating relative positions of scroll wraps of a fixed scroll and an orbiting scroll.

In the joint surface of the main frame 3 and the fixed scroll 41, a connecting portion 44 for connecting the discharge port of the oil supply passage 35 to the suction chamber 431 is provided. As shown in FIG. 2, the connecting portion 44 consists of a groove formed on a straight line along the radial direction from the outer peripheral direction to the inner peripheral direction of the fixed scroll 41. One end of the connecting portion 44 is located just above the discharge port of the oil supply passage 35, and the other end thereof is open to the suction chamber 431 in the compression chamber 43.

According to this configuration, the lubricating oil O having passed through the oil supply passage 35 and been brought up to the discharge port moves along the connecting portion 44 and is conveyed into the suction chamber 431. At this time, if a clearance 45 formed between the outer periphery of the end plate 421 of the orbiting scroll 42 and the inner periphery of the first concave portion 322 of the main frame 3 is too great, the lubricating oil O flows down into the low-pressure space 321, so that the quantity of oil supplied directly to the suction chamber 431 decreases.

Thereupon, in the present invention, a distance capable of performing orbiting motion is set so that in one turn of orbiting motion of the orbiting scroll 42, the outer edge portion of the end plate 421 of the orbiting scroll 42 is always included in the range of formation of the groove 44. According to this configuration, the lubricating oil O is conveyed through the groove 44 and easily supplied directly to the suction chamber 431 on the wrap side of the end plate 421 of the orbiting scroll 42. Therefore, the oil supply performance to the compression chamber 43 at the start time is improved.

In this embodiment, the scroll compressor is such that as shown in FIG. 2, the closing ends of the two compression chambers 43 formed at the outermost periphery at the time when the scroll wraps of the fixed scroll 41 and the orbiting scroll 42 are engaged with each other are symmetrical with respect to the center.

Figure 3:
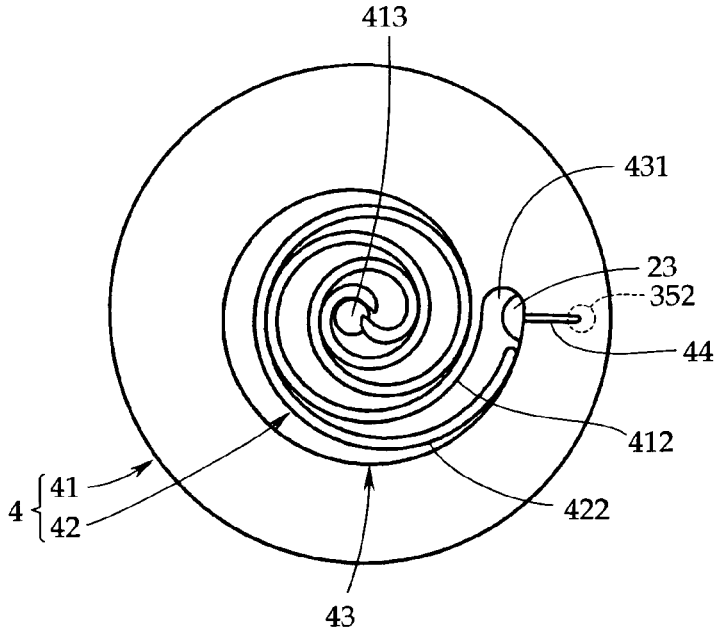
FIG. 3 is a schematic view showing a modification of the scroll wraps.

Besides, it is optional to use an asymmetric compression chamber scroll in which as shown in FIG. 3, the closing ends are in almost the same direction as viewed from the center axis. According to this configuration, the lubricating oil O discharged through the groove 44 easily enters both of the compression chambers 43 directly.

Also, in this embodiment, the connecting portion 44 is arranged between the refrigerant suction pipe 23 for sucking a low-pressure refrigerant into the compression chamber 43 and the outermost peripheral end of the orbiting scroll wrap. However, as shown in FIG. 3, the connecting portion 44 may be provided just under the refrigerant suction pipe 23, that is, in the same direction.

Further, in this embodiment, the connecting portion 44 consists of a connecting groove formed on the fixed scroll side of the joint surface of the fixed scroll 41 and the main frame 3. However, the connecting portion 44 may be provided on the main frame side.

Figure 4:
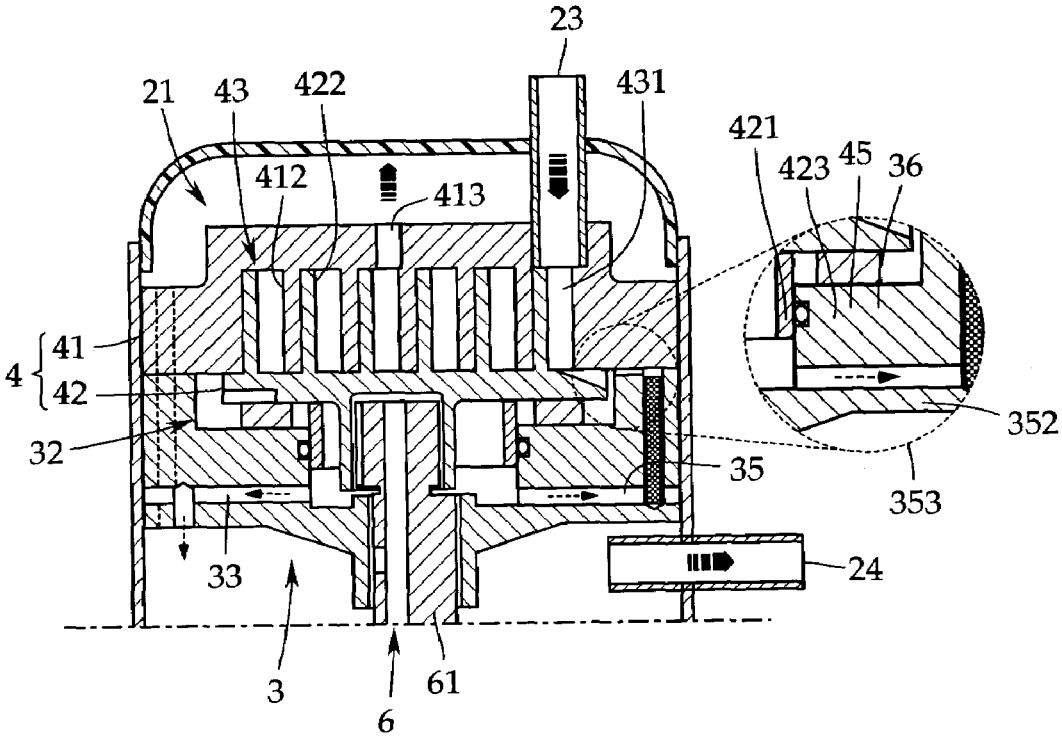
FIG. 4 is an explanatory view for illustrating a modification of a connecting portion.

Specifically, as shown in FIG. 4, a groove-shaped connecting portion 36 is provided in the joint surface (top end surface) of the main frame 3. In this case, however, the discharge direction of the connecting portion 36 is lower than the compression chamber 43, so that the lubricating oil O is less liable to enter the compression chamber 4 directly. Therefore, in order to supply the lubricating oil O surely, a notch 423 is provided at a part of the end plate 421 of the orbiting scroll 42 so that the lubricating oil O is taken into the compression chamber 43 through this notch 423. It is preferable that the connecting portion 36 and the notch 423 be formed on the same straight line including the orbiting range of the orbiting scroll 42.

When this scroll compressor 1 is driven, as shown in FIG. 1, the low-pressure refrigerant having finished its job is sucked into the compression chamber 43 through the refrigerant suction pipe 23 and the suction chamber 431, and compressed as the compression chamber 43 moves from the outer periphery side to the inner periphery side. The compressed high-pressure refrigerant is discharged into the discharge chamber 21 through the discharge port 413 and carried to the motor chamber 22 through a refrigerant passage 37 provided in the fixed scroll 41 and the main frame 3. Then, the high-pressure refrigerant is delivered to the refrigerating cycle again through the refrigerant discharge pipe 24.

Lubricating oil O is sucked up into the boss 423 of the orbiting scroll 42 through the lubricating oil supply tube 63 in the rotational driving shaft 6 by the rotation of the rotational driving shaft 6, and then lubricates a crank bearing at the inner periphery of the boss 423. At this time, some of the lubricating oil O is discharged through a lubrication hole 631 provided at the midpoint of the lubricating oil supply tube 63 to lubricate the main bearing 31 of the main frame 3. After lubricating the crank bearing and the main bearing, the lubricating oil O accumulating in the second concave portion 322 of the main frame 3 drips down into the motor chamber 22 through the oil discharge passage 33, and accumulates again in the bottom portion of the closed shell 2.

Some of the lubricating oil O is brought up to the joint surface of the main frame 3 and the fixed scroll 41 through the oil supply passage 35 by a difference in pressure, and sucked into the suction chamber 431 through the connecting portion 44.

The lubricating oil O having been sucked into the suction chamber 431 is sucked into the compression chamber 43 together with the sucked refrigerant, and forms a thin film between the wraps. Therefore, the reduction in friction of the sliding portions in the compression chamber 43 and the reduction in leakage of refrigerant improve the compression efficiency.

The lubricating oil O having finished the lubrication of the compression chamber 43 is discharged into the discharge chamber 21 through the discharge port 413 together with the high-pressure refrigerant, and returned into the motor chamber 22 through the refrigerant passage 37 together with the discharged refrigerant and drips down in the bottom portion of the closed shell 2.

In this embodiment, the refrigerant supply pipe 23 for supplying refrigerant into the suction chamber 431 is inserted from the upper end portion of the closed shell 2 into the suction chamber 431 in parallel with the axial direction. However, the refrigerant supply pipe 23 may be inserted horizontally from the side portion of the closed shell 2 into the suction chamber 431.

The above is an explanation of one preferred embodiment of the present invention given with reference to the accompanying drawings. The present invention is not limited to the above-described embodiment. Various changes and modifications that will occur to those skilled in the art, who are engaged in the field of the scroll compressor and have normal technical knowledge, within the scope of the technical concept described in the following claims are naturally embraced in the technical scope of the present invention.

The invention claimed is:

1. A scroll compressor comprising a refrigerant compressing section being formed with a compression chamber therein by engaging spiral scroll wraps erected on end plates of a fixed scroll and an orbiting scroll with each other, and a motor for driving said refrigerant compressing section are provided in a closed shell; a space between the end plate back surface of said orbiting scroll and a main frame is divided into a high-pressure space on the inside diameter side of a thrust ring and a low-pressure space on the outside diameter side thereof by said thrust ring that is in slidable contact with the end plate back surface of said orbiting scroll, and said low-pressure space communicates with a suction space at the outer periphery of wrap; and oil supply means is provided to introduce lubricating oil in the bottom portion of said closed shell to said high-pressure space, wherein said main frame includes an oil supply passage, in which a suction port at one end thereof is opened to said high-pressure space, and a discharge port at the other end thereof is opened to said low-pressure space or a suction chamber which is located on the outside of the scroll wraps and communicates with said low-pressure space, and a throttle pin, which is arranged in said oil supply passage with a predetermined clearance.

2. The scroll compressor according to claim 1, wherein said thrust ring is formed separately from said main frame, and provided so as to be movable finely with respect to said main frame along the axial direction of said motor, and the upper end face of said thrust ring is pressed against the end plate back surface of said orbiting scroll by a difference in pressure.

3. The scroll compressor according to claim 1, wherein said oil supply passage includes a transverse hole a suction port of which is open to said high-pressure space and a longitudinal hole in which a discharge port at one end thereof is open to a joint surface of said main frame and said fixed scroll and the other end thereof is open to said transverse hole, and said discharge port communicates with said suction chamber via a connecting groove formed in almost the entire range in the radial direction of said joint surface.

4. The scroll compressor according to claim 3, wherein said throttle pin is provided in said longitudinal hole.

5. The scroll compressor according to claim 3, wherein said connecting groove consists of a groove provided in the joint surface on the fixed scroll side.

6. The scroll compressor according to claim 3, wherein said connecting groove is formed in the direction such that said scroll is extended to the outside and in the vicinity of the outermost end of said orbiting scroll.

7. The scroll compressor according to claim 3, wherein the wrap shape of said scroll wrap is such that the outermost ends of substantially crescent-shapes are provided in almost the same direction as viewed from the center axis in a state of compression start of two compressor chambers formed at the outermost periphery.

8. The scroll compressor according to claim 3, wherein the end plate of said orbiting scroll is set so as to have an outside diameter such that in one turn of orbiting motion of said orbiting scroll, the outer edge portion thereof is always in contact with said groove.

* * * * *